US007155139B2

(12) United States Patent
Hong

(10) Patent No.: US 7,155,139 B2
(45) Date of Patent: Dec. 26, 2006

(54) SNAPFIT FOR FIXING ROLLER AND ROLLER ASSEMBLY OF OFFICE AUTOMATION MACHINE HAVING THE SAME

(75) Inventor: Jong-cheon Hong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 179 days.

(21) Appl. No.: 10/899,135

(22) Filed: Jul. 27, 2004

(65) Prior Publication Data

US 2005/0078980 A1 Apr. 14, 2005

(30) Foreign Application Priority Data

Oct. 11, 2003 (KR) ..... 10-2003-0070842

(51) Int. Cl.
*G03G 15/00* (2006.01)

(52) U.S. Cl. ..... 399/107; 399/122

(58) Field of Classification Search ..... 399/107, 399/115, 116, 121, 122, 313, 316; 271/272; 384/295, 428, 439
See application file for complete search history.

(56) References Cited

U.S. PATENT DOCUMENTS 5,265,859 A * 11/1993 Watson et al. ..... 271/109
5,457,520 A * 10/1995 Schell et al. ..... 399/117
6,300,970 B1 * 10/2001 Hamada et al. ..... 347/264
6,474,639 B1 * 11/2002 Borne et al. ..... 271/272

FOREIGN PATENT DOCUMENTS

| | | |
|---|---|---|
| JP | 5-134495 | * 5/1993 |
| JP | 2002-365939 | 12/2002 |
| KR | 1999-005176 | 2/1999 |
| KR | 1999-0039078 | 11/1999 |
| KR | 2000-0004285 | 3/2000 |
| KR | 2000-0012305 | 7/2000 |
| KR | 2003-0009829 | 2/2003 |

OTHER PUBLICATIONS

Korean Office Action dated Jul. 25, 2005.

* cited by examiner

*Primary Examiner*—Hoan Tran
(74) *Attorney, Agent, or Firm*—Roylance Abrams Berdo & Goodman LLP

(57) ABSTRACT

A snapfit for fixing a consumable roller such as a pickup roller to a corresponding shaft, facilitating the replacement of the roller. The snapfit includes a first fixing member and a second fixing member substantially symmetrical to each other with each having a catching portion formed at a first side for firmly engaging the shaft. The snapfit further includes a pressing portion formed at a second side, and preferably a hinge joint connecting the first and the second fixing members approximately in the middle of the first and the second fixing members. The first and the second fixing members may swing on the hinge joint toward or away from each other. The hinge joint may be a resilient to support the first and the second fixing members in a direction that closes the catching portions of the first and the second fixing members.

15 Claims, 3 Drawing Sheets

SNAPFIT FOR FIXING ROLLER AND ROLLER ASSEMBLY OF OFFICE AUTOMATION MACHINE HAVING THE SAME

CROSS-REFERENCE TO RELATED APPLICATIONS

This application claims the benefit under 35 U.S.C. §119 (a) of Korean Patent Application No. 2003-70842, filed on Oct. 11, 2003, in the Korean Intellectual Property Office, the disclosure of which is incorporated herein by reference in its entirety.

BACKGROUND OF THE INVENTION

1. Field of the Invention

The present invention relates to an office automation machine such as a printer, a photocopier, or a multi-function machine. More particularly, the present invention relates to a snapfit for fixing a consumable roller such as a pickup roller to a corresponding shaft, facilitating the replacement of the roller, and a roller assembly of an office automation machine having the same.

2. Description of the Related Art

A pickup roller, which is used in an office automation machine such as a printer, a photocopier, and a multi-function machine to pick-up a document paper, is more susceptible to failure due to wear as compared to the other rollers in the same machine. If the pickup roller is worn out, it is required to be replaced with a new one because a worn-out pickup roller has poor contact with the document to be picked up. Due to the poor contact pickup efficiency deteriorates. Accordingly, a pickup roller assembly employed in a general office automation machine has been designed to facilitate the replacement of the worn-out pickup roller.

The pickup roller assembly includes a pickup roller rotatably assembled with a rotary shaft, and a snapfit disposed on the shaft to prevent the pickup roller from disengaging from the shaft. The pickup roller comprises an inner housing and an outer roller portion. Because a part of the shaft hole of the inner housing and a part of the shaft, both formed by D-cut processing, are assembled together, the pickup roller can be rotated together with the shaft.

The snapfit, which is designed to firmly hold the pickup roller to the shaft and facilitate the replacement of the pickup roller, preferably uses an E-ring resiliently fitted into a circular recess formed on an outer circumference of the shaft in a predetermined depth. In addition to the E-ring, a variety of resilient rings having a similar construction to the E-ring, and a ring integrally formed with the housing are currently used.

SUMMARY OF THE INVENTION

It is an aspect of the present invention to provide a snapfit for fixing a roller to a corresponding shaft, which has a different construction from the various kinds of general snapfits, and facilitates the replacement of the roller.

It is another aspect of the present invention to provide a roller assembly of an office automation machine having the above snapfit.

The above aspects are achieved by providing a snapfit for a roller that firmly engages the roller with a corresponding shaft. The snapfit comprises a first fixing member and a second fixing member being symmetrical to each other, each having a catching portion formed at a first side for a firm engagement with the shaft and a pressing portion formed at a second side, and a hinge joint connecting the first and the second fixing members approximately in the middle of the first and the second fixing members. The first and the second fixing members swing on the hinge joint toward or away from each other. The hinge joint is resilient to support the first and the second fixing members in a direction that closes the catching portions of the first and the second fixing members.

A corresponding annular recess is formed in both the shaft and the catching portions. Each of the annular recesses are shaped in preferably an arcuate pattern such that the catching portions fit around the shaft on two sides of the annular recess.

The snapfit may further comprise a resilient member adding a resilient force to the resilient hinge joint.

The resilient member may be a compressible coil spring disposed between the pressing portions of the first and the second fixing members or an extendable coil spring disposed between the catching portions of the first and the second fixing members. According to another embodiment of the present invention, the snapfit for the fixing roller comprises a first fixing member and a second fixing member being symmetrical to each other. Both the first and second forming members each have a catching portion formed on a first side of the shaft for firm engagement with the shaft and a pressing portion formed at a second side. A hinge joint connects the first and the second fixing members approximately in the middle of the first and the second fixing members. The first and the second fixing members swing on the hinge joint toward or away from each other, and a resilient member supports the first and the second fixing members in a direction that closes the catching portions of the first and the second fixing members.

To achieve another aspect of the present invention, a roller assembly of an office automation machine comprises a shaft rotatably disposed in a frame of the office automation machine. A roller is engaged with the shaft to rotate together. A snapfit for fixing the roller is removably disposed at an end of the shaft to prevent the roller from moving from the shaft. The snapfit comprises a first fixing member and a second fixing member symmetrical to each other. Each of the fixing members have a catching portion formed at a first side to firmly engage the shaft and a pressing portion formed at a second side. A hinge joint connecting the first and the second fixing members approximately in the middle of the first and the second fixing members, which swing on the hinge joint toward or away from each other. The hinge joint is resilient to support the first and the second fixing members in a direction that closes the catching portions of the first and the second fixing members.

In an alternative embodiment, the snapfit may comprise a first fixing member and a second fixing member symmetrical to each other. Each of the fixing members have a catching portion formed at a first side to firmly engage the shaft and a pressing portion formed at a second side. A hinge joint connecting the first and the second fixing members approximately in the middle of the first and the second fixing members, which swing on the hinge joint toward or away from each other. Additionally, the snapfit comprises a resilient member for supporting the first and the second fixing members in a direction that closes the catching portions of the first and the second fixing members.

BRIEF DESCRIPTION OF THE DRAWING FIGURES

The above aspects and other advantages of the present invention will be more apparent by describing an exemplary embodiment of the present invention with reference to the accompanying drawing figures, in which.

In the drawing figures, it will be understood that like reference numerals refer to like features and structures.

DETAILED DESCRIPTION OF THE EXEMPLARY EMBODIMENTS

Hereinafter, exemplary embodiments of the present invention will be described in greater detail with reference to the accompanying drawings. The matters defined in the description such as a detailed construction and elements are provided to assist in a comprehensive understanding of the invention. Thus, for the sake of clarity, detailed descriptions of well-known functions or constructions are omitted.

Figure 1:
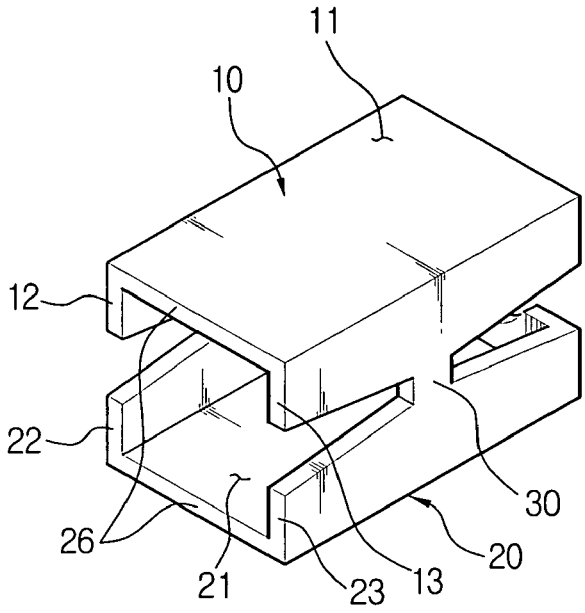
FIG. 1 is a perspective view showing a snapfit for fixing a roller according to an exemplary embodiment of the present invention.
Figure 2:
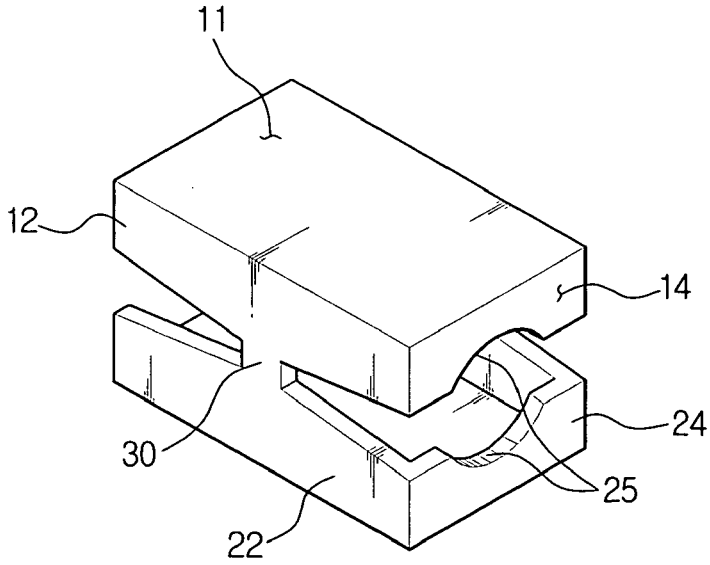
FIG. 2 is a rear side perspective view of FIG. 1 according to an embodiment of the present invention.

FIGS. 1 and 2 are views showing a snapfit for fixing a roller according to an exemplary embodiment of the present invention. As shown in FIGS. 1 and 2, the snapfit preferably comprises a first fixing member 10, a second fixing member 20, and a resilient hinge joint 30.

Referring to FIGS. 1 and 2, the first and the second fixing members 10 and 20 are substantially symmetrical to each other, and connected to each other by the resilient hinge joint 30 on which they swing toward or away from each other.

The first fixing member 10 comprises a base plate 11 flanked with side plates 12 and 13, and a rear plate 14 substantially extended from the back of the base plate 11. The second fixing member 20 is substantially a mirror image of the first fixing member 10 and also comprises a base plate 21, side plates 22 and 23 and a rear plate 24.

The resilient hinge joint 30 connects approximately middle portions of the side plates 12, 13, 22, and 23. Each side plate 12, 13, 22, and 23 are formed in an inclined manner so that its width gradually decreases as it extends away in both directions from the resilient hinge joint 30. Accordingly, the first fixing member 10 and the second fixing member 20 are enabled to turn on the resilient hinge joint 30 relative to each other.

The first and the second fixing members 10 and 20 each have a catching portion 25 formed at a first side and a press portion 26 formed at a second side. The catching portion 25 is formed by cutting a certain area from the first side of the rear plate 14 and 24 in a substantially arcuate pattern. The catching portions 25 of the first and the second fixing members 10 and 20 are formed to be symmetrical to each other. The press portion 26 is preferably formed at a front portion of the base plate 11 and 21 in an approximately rectangular shape.

Meanwhile, the resilient hinge joint 30 supports the first and the second fixing members 10 and 20 such that the first and the second fixing members 10 and 20 are closer to each other. The catching portions 25 stay in a closed state when not in use, and when the press portions 26 are pressed, the catching portions 25 move farther away from each other. When the press portions 26 are pressed toward each other, the snapfit grasps a shaft, and if pressure is released from the press portions 26, the catching portions 25 snap back to the original state by the recovering force of the resilient hinge joint 30. Accordingly, the snapfit is snapped onto the shaft.

The snapfit for fixing a roller may be made of a variety of appropriate materials, but it is preferred that the snapfit is made of plastic in consideration of molding efficiency and productivity.

Figure 3:
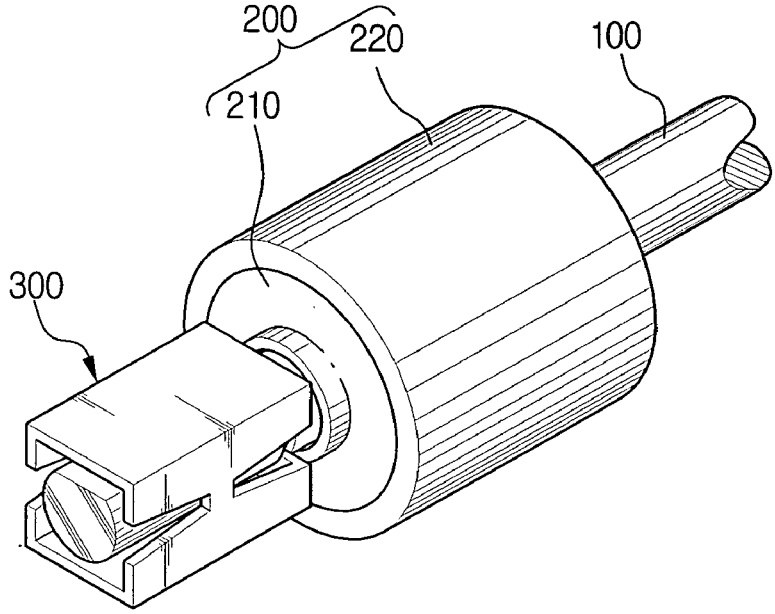
FIG. 3 is a perspective view showing a roller assembly in which a roller is fixed over a shaft by the snapfit according to an embodiment of the present invention.
Figure 4:
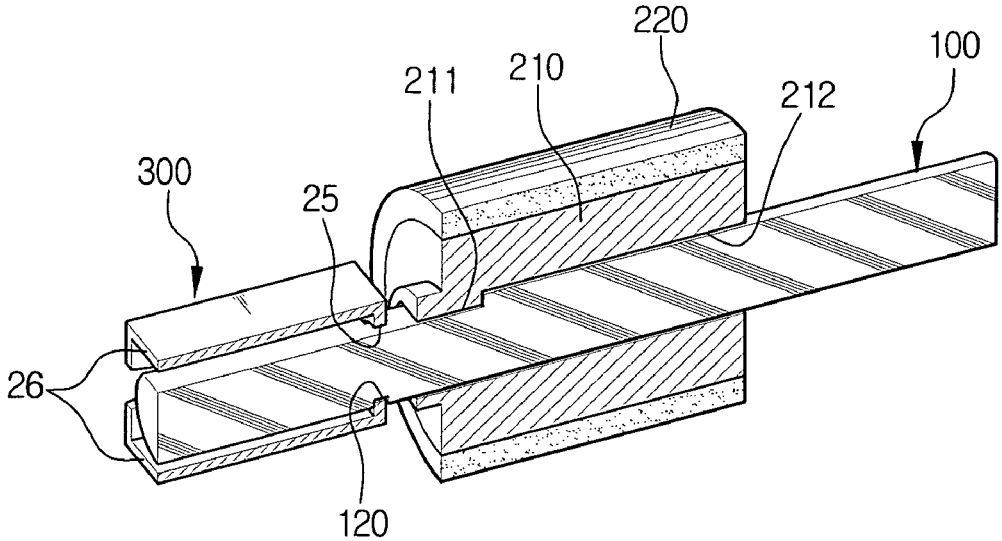
FIG. 4 is a cross-section view of FIG. 3 according to an embodiment of the present invention.
Figure 5:
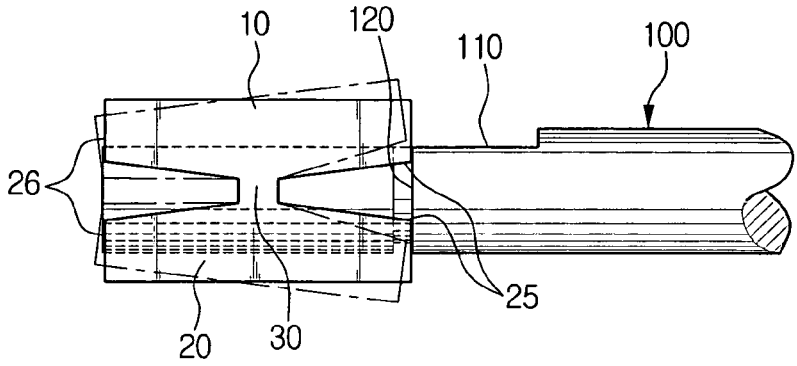
FIG. 5 is a view explaining the operation of the snapfit attached to the shaft of the roller assembly according to an embodiment of the present invention.

FIGS. 3 to 5 are views showing a roller assembly of an office automation machine according to an embodiment of the present invention, in which a roller is assembled with the shaft by using the snapfit with the above-described construction.

Referring to FIGS. 3 to 5, reference numeral 100 indicates a shaft, reference numeral 200 is a roller, and reference numeral 300 is the snapfit.

The shaft 100 is rotatably disposed in a body frame of the office automation machine, and preferably has a D-cut portion 110 (see FIG. 5) formed thereon. An annular recess 120 is also preferably formed in the D-cut portion 110 to a predetermined depth.

The roller 200 comprises an inner housing 210 and an outer roller portion 220. The inner housing 210 has a shaft hole 212 which preferably includes another D-cut portion 211 therein, and the shaft 100 is inserted in the shaft hole 212 so that the roller 200 rotates with the shaft 100.

The arcuate catching portion 25 of the snapfit 300 is firmly fitted around the annular recess 120 of the shaft 100, preventing the snapfit 300 from moving on the shaft 100. Therefore, the snapfit 300 prevents the roller 200 from falling from the shaft 100 to the exterior.

To replace the roller 200 of the roller assembly according to an embodiment of the present invention, firstly, the user presses the press portions 26 of the snapfit 300 to release the snapfit 300 from the shaft 100. Next, the roller 200 is separated from the shaft 100 and then, a new roller is installed on the shaft 100. Then, as the user places the snapfit 300 on the shaft 100 and releases the press portions 26, the catching portions 25 are drawn toward each other due to the recovery force of the resilient hinge joint 30, and therefore, are inserted in the recess 120 of the shaft 100.

Figure 6A:
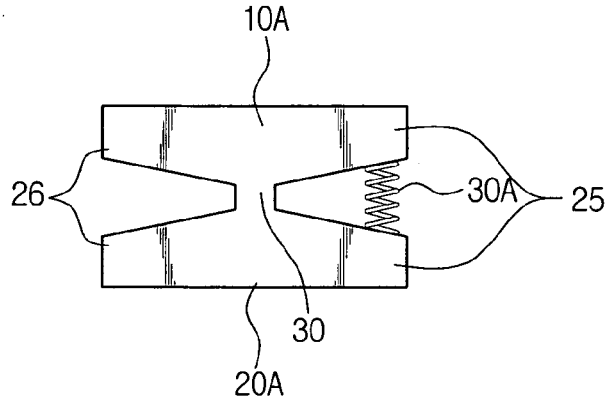
FIGS. 6A and 6B are views showing snapfits for fixing a roller according to additional embodiments of the present invention.
Figure 6B:
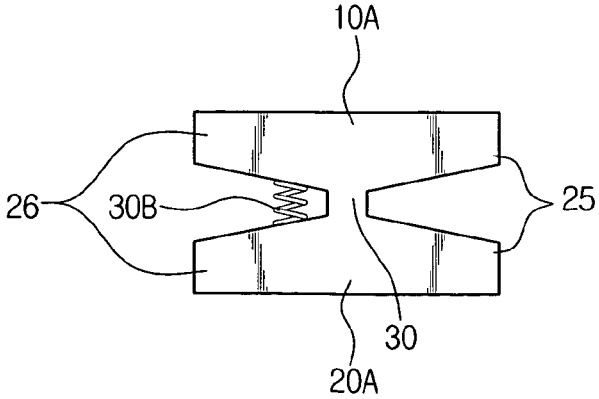

FIGS. 6A and 6B are views showing snapfits according to other embodiments of the present invention. The snapfits according to the other embodiments of the present invention comprise an additional resilient member that supports the first and second fixing members 10A and 20A in a direction that closes catching portions 25.

More specifically, the resilient member illustrated in FIG. 6A is an extension coil spring 30A that is disposed between the catching portions 25, which supports the first and the second fixing members 10A and 20A in a direction that closes the catching portions 25.

FIG. 6B illustrates another embodiment in which a compressible coil spring 30B is employed as the resilient member. The compressible coil spring 30B is disposed between press portions 26, which supports the first and the second fixing members 10A and 20A in a direction that closes catching portions 25.

Any adequate hinges or the resilient hinge joint 30 used in the first embodiment may be used.

In the presence of the resilient hinge joint 30, the resilient members 30A and 30B operate to aid the resilient force of the resilient hinge joint 30. Alternatively, when a general hinge is used in place of resilient joint 30, the first and the second fixing members 10A and 20A are subjected to the resilient force of the resilient members 30A or 30B.

According to the present invention as described above, the roller assembly of the office automation machine such as a pickup roller is constructed to facilitate the roller replacement, which makes replacement by the user more convenient.

The foregoing embodiments and advantages are merely exemplary and are not to be construed as limiting the present invention. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A snapfit for a roller for firmly holding the roller in an engagement with a corresponding shaft, the snapfit comprising:

a first fixing member and a second fixing member, each having a catching portion formed at a first side for firmly engaging the shaft and a pressing portion formed at a second side; and a hinge joint connecting the first and the second fixing members approximately in the middle of the first and the second fixing members, the first and the second fixing members swinging on the hinge joint toward or away from each other, the hinge joint being resilient to support the first and the second fixing members in a direction that closes the catching portions of the first and the second fixing members.

2. The snapfit of claim 1, wherein the first fixing member and the second fixing member are substantially symmetrical to each other.

3. The snapfit of claim 1, wherein an annular recess is formed in the shaft, and said catching portions are shaped in an arcuate pattern such that said catching portions are fitted around the shaft from two sides of the annular recess.

4. The snapfit of claim 3, further comprising a resilient member adding a resilient force to the resilient hinge joint.

5. The snapfit of claim 4, wherein the resilient member is a compress coil spring disposed between the pressing portions of the first and the second fixing members.

6. The snapfit of claim 4, wherein the resilient member is an extension coil spring disposed between the catching portions of the first and the second fixing members.

7. A snapfit for a roller for firmly holding the roller in an engagement with a corresponding shaft, the snapfit comprising:

a first fixing member and a second fixing member, each having a catching portion formed at a first side for firmly engaging the shaft and a pressing portion formed at a second side;

a hinge joint connecting the first and the second fixing members approximately in the middle of the first and the second fixing members, said first and second fixing members swinging on said hinge joint toward or away from each other; and a resilient member for supporting said first and second fixing members in a direction that closes said catching portions of the first and the second fixing members.

8. The snapfit of claim 7, wherein the first fixing member and the second fixing member are substantially symmetrical to each other.

9. The snapfit of claim 7, wherein an annular recess is formed in said shaft and said catching portions each are shaped in an arcuate pattern such that said catching portions are fitted around the shaft from two sides of said annular recess.

10. The snapfit of claim 8, wherein said resilient member is a compress coil spring disposed between said pressing portions of said first and second fixing members.

11. The snapfit of claim 8, wherein said resilient member is an extension coil spring disposed between the catching portions of said first and second fixing members.

12. A roller assembly of an office automation machine, comprising:

a shaft rotatably disposed in a frame of the office automation machine;

a roller engaged with said shaft to rotate together; and a snapfit for fixing the roller, said snapfit being removably disposed at the end of said shaft to prevent said roller from moving from said shaft, said snapfit comprising:

a first fixing member and a second fixing member, each having a catching portion formed at a first side for a firm engagement with said shaft and a pressing portion formed at a second side; and a hinge joint connecting the first and the second fixing members approximately in the middle of the first and the second fixing members, the first and the second fixing members swinging on the hinge joint toward or away from each other, said hinge joint being resilient to support the first and the second fixing members in a direction that closes the catching portions of the first and the second fixing members.

13. The roller assembly of claim 12, wherein said first fixing member and said second fixing member are substantially symmetrical to each other.

14. A roller assembly of an office automation machine, comprising:

a shaft rotatably disposed in a frame of said office automation machine;

a roller engaged with the shaft to be rotated altogether; and a snapfit for fixing the roller, said snapfit being removably disposed at an end of said shaft to prevent the roller from moving from said shaft, said snapfit comprising:

a first and second fixing members, each having a catching portion formed at a first side for a firm engagement with said shaft and a pressing portion formed at a second side;

a hinge joint connecting the first and second fixing members approximately in the middle of the first and the second fixing members, said first and second fixing members swinging on said hinge joint toward or away from each other; and a resilient member for supporting said first and second fixing members in a direction that closes said catching portions of said first and second fixing members.

15. The roller assembly of claim 14, wherein said first and second fixing members are substantially symmetrical to each other.

* * * * *